US005655491A

United States Patent [19]

Nishiyama

[11] Patent Number: 5,655,491

[45] Date of Patent: Aug. 12, 1997

[54] IGNITION PLUG CAP

[75] Inventor: Naomasa Nishiyama, Shizuoka, Japan

[73] Assignee: Yazaki Corporation, Tokyo, Japan

[21] Appl. No.: 642,531

[22] Filed: May 3, 1996

[30] Foreign Application Priority Data

May 12, 1995 [JP] Japan ..... 7-114328

[51] Int. Cl.[6] ..... F02P 1/00

[52] U.S. Cl. ..... 123/169 PA

[58] Field of Search ..... 123/169 PA, 169 P, 123/169 PH, 627, 635, 260; 428/1

[56] References Cited

U.S. PATENT DOCUMENTS

| | | | |
|---|---|---|---|
| 2,467,531 | 4/1949 | Lamphere et al. | 123/169 PA |
| 4,325,332 | 4/1982 | Hukill | 123/169 PA |
| 4,516,548 | 5/1985 | May | 123/260 |
| 4,947,809 | 8/1990 | Hocking | 123/169 PA |
| 5,080,083 | 1/1992 | Sato et al. | 123/627 |
| 5,476,695 | 12/1995 | Okada et al. | 428/1 |
| 5,537,983 | 7/1996 | Nakajima | 123/635 |

FOREIGN PATENT DOCUMENTS 49-114332 9/1974 Japan .

*Primary Examiner*—Raymond A. Nelli

*Attorney, Agent, or Firm*—Armstrong, Westerman, Hattori, McLeland & Naughton

[57] ABSTRACT

An ignition plug cap for connecting an ignition plug terminal and a high tension cable, having a rubber cap at the lower end portion thereof and a plug cap pipe connected with the rubber cap, wherein the ignition plug cap further comprises a flange having a longer diameter than that of the rubber cap and integrally formed on the external surface of the plug cap pipe with its lower surface abutted to the rubber cap.

3 Claims, 1 Drawing Sheet

IGNITION PLUG CAP

BACKGROUND OF THE INVENTION

1. Field of the Invention

The present invention relates to an ignition plug cap for connecting an ignition plug with a high tension cable in an automotive engine in which an ignition plug is accommodated in an ignition plug mounting hole formed in the engine block thereof, wherein the ignition plug cap is composed of three principal members; a rain cover, a plug cap pipe and a rubber cap.

2. Description of the Prior Art

Heretofore, there have been provided various ignition plug caps for connecting an ignition plug with a high tension cable in an automotive engine in which an ignition plug is accommodated in an ignition plug mounting hole formed in the engine block thereof, a case in point being the one disclosed in FIG. 2.

In the figure, it is shown that the ignition plug cap is composed of a three principal members; a plug cap pipe 1 which is provided with an empty hole 4 for accommodating a plug terminal of the ignition plug and covering also a high tension cable 6 and a connection terminal 2, a rain cover 5 made of a resilient material and covering the upper end portion of the plug cap pipe 1 and a rubber cap 3 which is also made of a resilient material such as silicon rubber attached to the lower end portion of the plug cap pipe 1.

Here, the rain cover 5 is fitted with the upper end portion of the ignition plug mounting hole formed in an engine block for prohibiting immersion of waterdrops or the like into the mounting hole and also for properly positioning and holding the plug cap itself. The connecting terminal 2 electrically connects a plug terminal of the ignition plug (not shown) inserted to the empty hole 4 with the high tension cable 6. The plug cap pipe 1 prevents a high voltage applied to the connecting terminal 2 and the plug terminal of the ignition plug from leaking into the engine block. Further, the rubber cap 3 is fitted with an insulator of the ignition plug for properly positioning and holding the ignition plug itself, and prohibiting simultaneously the moisture substance from immersing into the plug terminal of the ignition plug and to the connecting terminal 2, to which a high electric voltage is applied, so as to prevent the leaking thereof into the engine block and provide thereby a secure ignition of the ignition plug. It is to be noted that as a rubber cap anti-defection mechanism, the plug cap pipe 1 is provided with an annular projection rib 1*a* and the rubber cap 3 is provided with an annular groove 3*a* for receiving the annular projection rib 1*a*.

In the above construction, however, there has been such a problem that the rubber cap 3 and the plug cap pipe 1 are made of different materials respectively, and thus not made as an integral body. For this reason, when removing the ignition plug cap from the ignition plug mounting hole for its maintenance and/or replacement purpose, the rubber cap 3 is abutted against the side surface of this mounting hole, as shown in FIG. 3, resulting that the upper end portion of the rubber cap 3 is ripped off.

In this case, if, after a detection and/or a replacement of the ignition plug, the ignition plug cap is reinserted into the ignition plug mounting hole with the rubber cap 3 being left in the ripped off state, and supposing that an immersion of waterdrops to the mounting hole occurs and the moisture is attached to the plug cap pipe 1, then the connected portion between the ignition plug and the connecting terminal 2, to which a high voltage is applied, also gets wet, generating thereby an imperfect insulation therebetween. By the way, the voltage normally applied to ignition plugs is between 15 Kv and 20 Kv, so that even such extremely subtle moisture could leak into the engine block, impeding thereby a normal starting-up operation of the engine.

Further, it is to be noted that the ignition plug cap as above is made by applying an insert molding operation to the rubber plug cap 3 after the fabrication of the plug cap pipe 1. However, as it is not possibly control to put the plug cap pipe 1 in a mould at a perfectly proper position, a molding operation with the plug cap pipe being left upright with respect to the mould split surface cannot be conducted, due to which the plug cap pipe has to be laid during the molding operation. Therefore, the number of outputs obtained by one molding procedure becomes small, resulting that the manufacturing cost of the ignition plug becomes high.

The present invention is made for solving the above problem, and it is an object of the present invention to provide an ignition plug cap in which the rubber cap is not readily ripped off even during a detecting and/or repairing operation, providing thereby a comfortable working condition, a stable engine starting operation, and also providing an efficient productivity thereof.

SUMMARY OF THE INVENTION

In order to accomplish the above object, an ignition plug cap for connecting an ignition plug terminal and a high tension cable according to the present invention is provided with a rubber cap at the lower end portion thereof and a plug cap pipe connected with the rubber cap, wherein the ignition plug cap further comprises a flange portion having a longer diameter than that of the rubber cap and integrally formed on the external surface of the plug cap pipe with its lower surface abutted to the rubber cap.

Here, considering the situation in which an external force is exerted to the upper end of the rubber cap, it is preferable if this flange is formed as the thickest part of the plug cap pipe, and that the difference between the external diameter and that of the flange is more than 2 mm. Further, it will be also preferable if the flange is made in a disc shape from its operational point of view.

In the present invention, since the flange having a longer diameter than that of the rubber cap is integrally formed on the external surface of the plug cap pipe, and abutted to the upper end of the rubber cap, even in the event that the ignition plug cap is removed from the ignition plug mounting hole for a detecting, repairing, and/or a replacing operation, as the upper end of the rubber cap is protected by the flange, no external force is exerted thereto, and an external force exerted to the side portion thereof is also greatly reduced, resulting that the upper end portion is not readily ripped off.

In addition, since the flange is integrally formed on the external surface of the plug cap pipe 1, if the lower surface of the flange is adjusted to the mould split surface, it is made possible to hold the plug cap pipe being set upright, so that an insert molding operation can also be conducted to the rubber cap with the pug cap pipe set upright.

Other features and advantages of the invention will be apparent from the following description taken in connection with the accompanying drawing.

DETAILED DESCRIPTION OF THE PREFERRED EMBODIMENTS

In the following, one embodiment of the present invention is explained.

Figure 1:
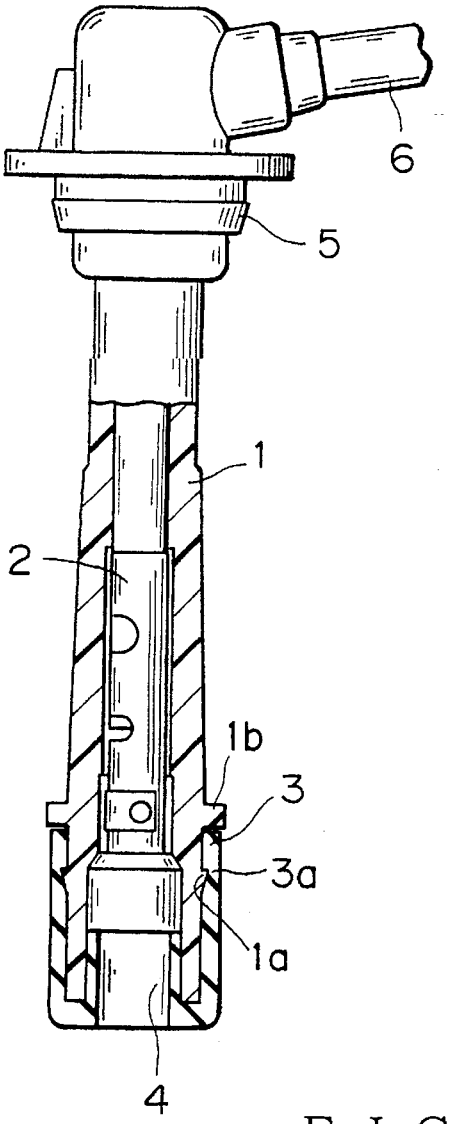
FIG. 1 is a sectional view of an ignition plug cap according to the present invention.
Figure 2:
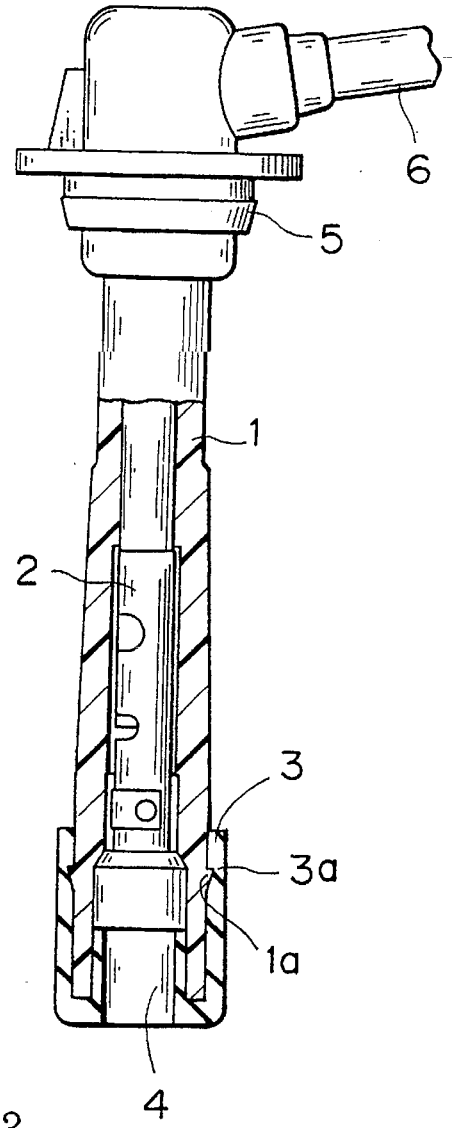
FIG. 2 PRIOR ART
FIG. 2 is a sectional view of an ignition plug cap of a conventional type.
Figure 3:
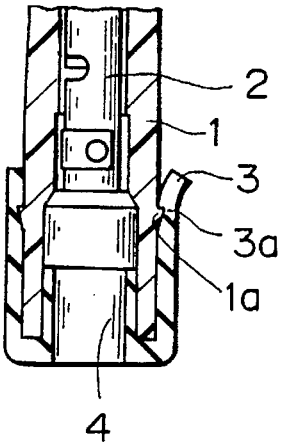
FIG. 3 PRIOR ART
FIG. 3 is a magnified view showing a state that an external force is exerted to the upper end portion in a conventional ignition plug cap.

FIG. 1 shows an ignition plug cap according to the present invention, wherein it is composed of a rain cover 5, a plug cap pipe 1 having an empty hole 4 for accommodating the upper end portion of the ignition plug and covering also a connecting terminal 2, and a rubber cap 3. Here, the connecting terminal 2 is connected with a high tension cable 6, and the upper end of an ignition plug (not shown) is inserted into the empty hole 4, and the rubber cap 3 is fitted with an insulator of the ignition plug.

The plug cap pipe 1 and a rubber cap 3 are provided respectively with an annular projection rib 1*a* and an annular groove 3*a* as a rubber cap anti-defection mechanism. Further, the plug cap pipe 1 is integrally formed with a flange 1*b* having a longer diameter than that of the rubber cap, which flange being abutted against the upper end of the rubber cap 3. It is to be noted that the flange 1*b* is the thickest portion of the plug cap pipe.

In the event that the ignition plug is removed from the mounting hole thereof for a detecting, repairing, and/or a replacing operation, as the upper end of the rubber cap is protected by the flange, no external force is exerted thereto, and an external force exerted to the side portion thereof is also greatly reduced, resulting that the upper end portion is not readily ripped off.

In addition, since the ignition plug cap of the present invention is provided with a flange 1*b* on the plug cap pipe 1, by holding the lower surface thereof with a split surface of the mould, the rubber cap 3 can be formed by an insert molding method with the plug cap pipe being upright.

In other words, the ignition plug cap of the present invention is fabricated by electrically connecting the connecting terminal 2 with the high tension cable 6 first, putting this into a mould to form a plug cap pipe 1 which is made of rigid resin and having integrally a flange 1*b*. In this case, the plug cap pipe can be set being upright by adjusting the lower surface of the flange 1*b* to the split surface of the mould as the supporting surface thereof, and thereafter the rubber cap is molded by silicon rubber. Here, a core mould is used simultaneously in order to securely obtain the empty hole 4. Then an individually fabricated rain cover is mounted thereon.

[Effect of the Invention]

In the present invention since the flange having a longer diameter than that of the rubber cap is integrally formed on the external surface of the plug cap pipe and abutted to the upper end of the rubber cap, the handling of the product is made easy even in the case of a detecting, repairing, and/or a replacing operation, enabling thereby a stable engine starting operation.

Further in the present invention, as the upper end of the rubber cap is protected by the flange integrally formed with the plug cap pipe, no waterdrop is immersed through a space between the rubber cap and the plug cap pipe, enabling thereby a greatly improved prevention of a defective insulation thereof.

Still further, since it is made possible to hold the plug cap pipe being upright by making the lower surface of the flange a supporting surface thereof during its insert molding operation, the number of outputs obtained by one molding procedure increases, the productivity is greatly improved, and thus the manufacturing cost of the ignition plug is efficiently suppressed.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. An ignition connector assembly for interconnecting an ignition plug terminal and a high tension ignition cable, said connector assembly having a rubber cap at a lower portion thereof and a plug cap pipe connected with said rubber cap, said connector assembly further comprising:

a flange having a greater diameter than a diameter of said rubber cap and integrally formed on an external surface of said plug cap pipe with said flange having its lower surface abutted to said rubber cap to avoid ripping of the upper portion of said rubber cap during maintenance.

2. An ignition connector assembly as claimed in claim 1, wherein said flange is formed in a disc shape.

3. An ignition connector assembly as claimed in claim 1 or claim 2, wherein said flange is the thickest part of said ignition plug cap pipe.

* * * * *